US009048581B2

(12) United States Patent
Briant

(10) Patent No.: US 9,048,581 B2
(45) Date of Patent: Jun. 2, 2015

(54) ELECTRICAL CONNECTORS AND RECEPTACLE ASSEMBLIES HAVING RETENTION INSERTS

(71) Applicant: Tyco Electronics Corporation, Berwyn, PA (US)

(72) Inventor: Eric David Briant, Dillsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 163 days.

(21) Appl. No.: 13/933,933

(22) Filed: Jul. 2, 2013

(65) Prior Publication Data

US 2015/0011110 A1 Jan. 8, 2015

(51) Int. Cl.
*H01R 13/627* (2006.01)
*H01R 13/639* (2006.01)

(52) U.S. Cl.
CPC ..... *H01R 13/639* (2013.01)

(58) Field of Classification Search
CPC ..... H01R 13/639
USPC ..... 439/350, 637, 357, 680, 660, 74, 79, 80
See application file for complete search history.

(56) References Cited

U.S. PATENT DOCUMENTS

| | | | | |
|---|---|---|---|---|
| 3,594,699 | A | 7/1971 | Jayne et al. | |
| 3,670,290 | A | 6/1972 | Angele et al. | |
| 3,744,005 | A | 7/1973 | Sitzler | |
| 3,958,852 | A | 5/1976 | Abraham et al. | |
| 3,990,761 | A | 11/1976 | Jayne | |
| 4,025,147 | A | 5/1977 | Van Arsdale et al. | |
| 4,077,688 | A | 3/1978 | Cobaugh et al. | |
| 4,501,465 | A | 2/1985 | Hoshino et al. | |
| 5,820,392 | A | 10/1998 | Lin et al. | |
| 5,904,581 | A * | 5/1999 | Pope et al. | 439/74 |
| 6,129,594 | A | 10/2000 | Lai | |
| 6,491,536 | B1 | 12/2002 | Torii | |
| 6,743,053 | B2 | 6/2004 | Wu | |
| 6,942,524 | B2 | 9/2005 | Wu | |

(Continued)

FOREIGN PATENT DOCUMENTS

| | | |
|---|---|---|
| EP | 2 515 382 A1 * | 10/2012 |
| JP | 2005197597 | 7/2005 |

OTHER PUBLICATIONS

European Search Report, European Application No. EP12 16 4049, European Filing Date Apr. 13, 2012.

(Continued)

*Primary Examiner* — Javaid Nasri

(57) ABSTRACT

An electrical connector includes a housing extending from a mating face to an opposite face, and first and second side walls that extend between the mating face and the opposite face. The housing has a contact cavity that includes opposing sides. The first side wall includes a side opening that extends through the first side wall into communication with the contact cavity. The contact cavity is accessible through the mating face for receiving a mating connector therein. Electrical contacts are held by the housing and arranged in opposing rows that extend along the opposing sides of the contact cavity. A retention insert is received within the side opening. The retention insert includes fingers that extend into the contact cavity and engage in physical contact with corresponding electrical contacts of one of the rows of the electrical contacts to hold the corresponding electrical contacts within the contact cavity.

20 Claims, 7 Drawing Sheets

(56) References Cited

U.S. PATENT DOCUMENTS

| | | | |
|---|---|---|---|
| 7,210,955 | B2 | 5/2007 | Ringler et al. |
| 7,291,031 | B2 | 11/2007 | Crofoot et al. |
| 7,351,091 | B1 | 4/2008 | Zhang |
| 7,553,191 | B2 | 6/2009 | Su et al. |
| 7,710,734 | B2 | 5/2010 | Ice et al. |
| 7,833,068 | B2 | 11/2010 | Bright et al. |
| 7,859,849 | B2 | 12/2010 | Ice |
| 8,449,335 | B2 | 5/2013 | Briant et al. |
| 2004/0110398 | A1 | 6/2004 | Chen |

OTHER PUBLICATIONS http://www.te.com/catalog/pn/en/2110819-1.

* cited by examiner

ELECTRICAL CONNECTORS AND RECEPTACLE ASSEMBLIES HAVING RETENTION INSERTS

BACKGROUND OF THE INVENTION

The subject matter described and/or illustrated herein relates generally to electrical connectors, and more particularly, to electrical connectors that are configured to receive and communicatively engage an edge of a mating connector.

Various communication or computing systems use electrical connectors for transmitting data signals between different components of the systems. For example, some electrical connectors may be configured to receive an edge of an electrical component having component contacts located therealong. The electrical connectors may include housing cavities having opposing rows of mating contacts. When the edge is advanced into the housing cavity of the electrical connector, the edge moves between the opposing rows of mating contacts. The component contacts electrically engage the mating contacts in the housing cavity.

Electrical connectors such as those described above may be manufactured by molding a housing with holes and then inserting the mating contacts through corresponding holes. Alternatively, the housing may be directly molded around the rows of mating contacts so that each mating contact is held in place by molded material that surrounds the mating contact. However, such electrical connectors may have certain limitations. For example, mating contacts that have shapes or dimensions that predispose the mating contacts to deformation may be inadvertently bent when inserted into the hole. Furthermore, molding the housing around the mating contacts may be costly as compared to other manufacturing methods. In some cases, the above manufacturing methods may limit a manufacturer's ability to design electrical connectors with improved performance.

Moreover, the holes of the housing include retention sections that are engaged by retention segments of the mating contacts to hold the mating contacts within the holes. The retention sections of the holes must be large enough to enable mating segments of the mating contacts to pass through the retention sections as the mating contacts are loaded into the holes. The retention segments of the mating contacts therefore need to have a size that is large enough to span (i.e., fill) the retention sections of the holes and thereby securely engage the housing. But, such a size of the retention segments may negatively affect the electrical characteristics of the mating contacts. For example, such a size of the retention segments may degrade the integrity of signals transmitted through the mating contacts and/or may cause electrical discontinuities, such as, but not limited to, reflections, impedance differences, electrical stubs, etc.

Accordingly, there is a need for electrical connectors that provide good electrical performance and are easy to manufacture at relatively low cost.

BRIEF DESCRIPTION OF THE INVENTION

In an embodiment, an electrical connector includes a housing extending from a mating face to an opposite face. The housing includes first and second side walls that extend between the mating face and the opposite face. The housing has a contact cavity that includes opposing sides. The first side wall includes a side opening that extends through the first side wall into communication with the contact cavity. The contact cavity is accessible through the mating face for receiving a mating connector therein. Electrical contacts are held by the housing. The electrical contacts are arranged in opposing rows that extend along the opposing sides of the contact cavity. A retention insert is received within the side opening of the first side wall of the housing. The retention insert includes fingers that extend into the contact cavity and engage in physical contact with corresponding electrical contacts of one of the rows of the electrical contacts to hold the corresponding electrical contacts within the contact cavity.

In an embodiment, a receptacle assembly includes a circuit board having a board surface, and an electrical connector configured to be mounted to the board surface of the circuit board in electrical connection with the circuit board. The electrical connector includes a housing extending from a mating face to an opposite face. The housing includes first and second side walls that extend between the mating face and the opposite face. The housing has a contact cavity that includes opposing sides. The first side wall includes a side opening that extends through the first side wall into communication with the contact cavity. The contact cavity is accessible through the mating face for receiving a mating connector therein. Electrical contacts are held by the housing. The electrical contacts are arranged in opposing rows that extend along the opposing sides of the contact cavity. A retention insert is received within the side opening of the first side wall of the housing. The retention insert includes fingers that extend into the contact cavity and engage in physical contact with corresponding electrical contacts of one of the rows of the electrical contacts to hold the corresponding electrical contacts within the contact cavity.

In an embodiment, an electrical connector includes a housing extending from a mating face to an opposite face. The housing includes first and second side walls that extend between the mating face and the opposite face. The housing has a contact cavity that includes opposing sides. The first and second side walls include first and second side openings, respectively, that extend through the first and second side walls, respectively, into communication with the contact cavity. The contact cavity is accessible through the mating face for receiving a mating connector therein. Electrical contacts are held by the housing. The electrical contacts are arranged in opposing first and second rows that extend along the opposing sides of the contact cavity. First and second retention inserts are received within the first and second side openings, respectively, of the housing. The first and second retention inserts include respective first and second pluralities of fingers that extend into the contact cavity and engage in physical contact with corresponding electrical contacts of the first and second rows, respectively, to hold the corresponding electrical contacts within the contact cavity.

DETAILED DESCRIPTION OF THE INVENTION

Figure 1:
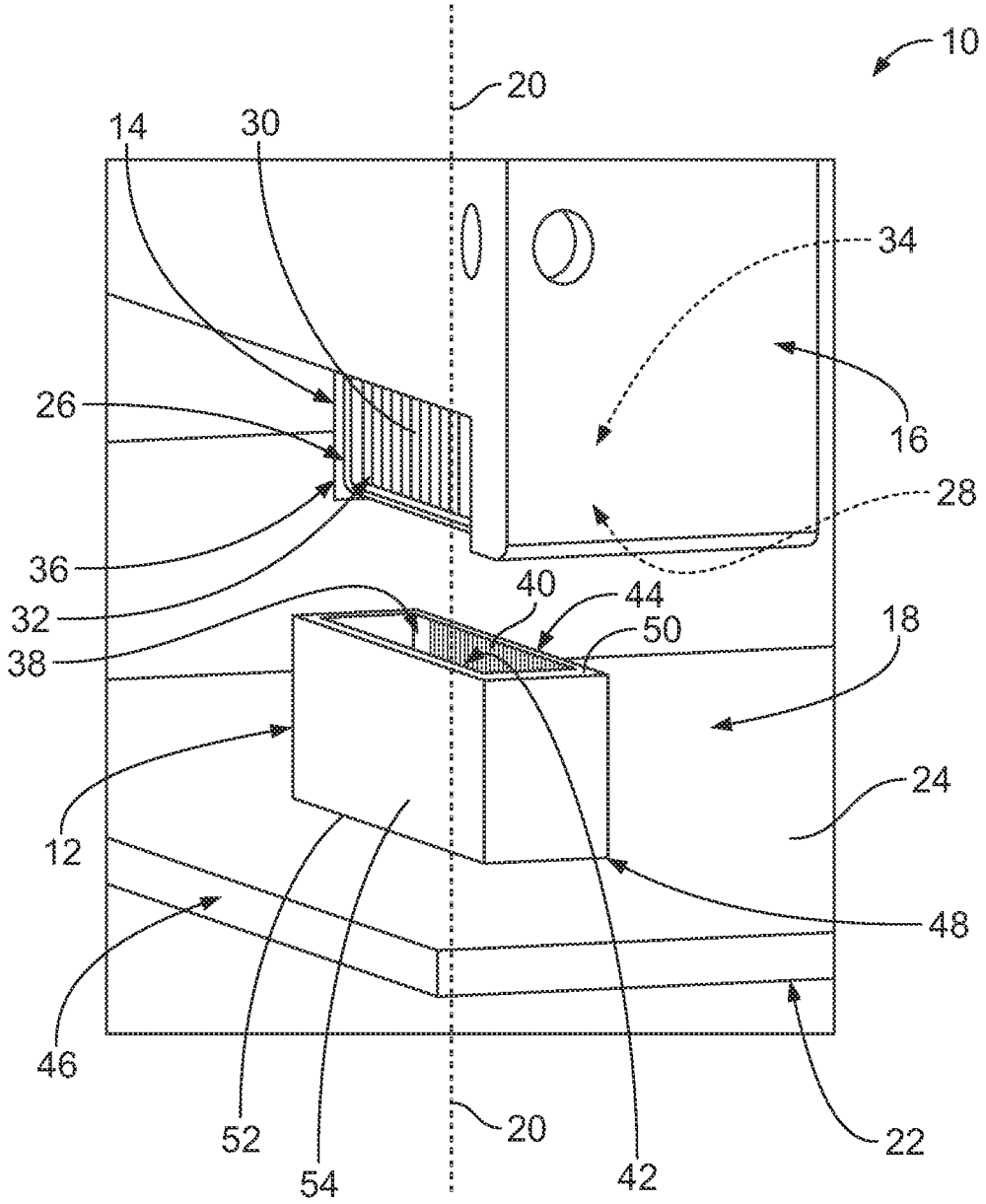
FIG. 1 is a perspective view of an embodiment of a communication system.

FIG. 1 is a perspective view of an embodiment of a communication system 10. The communication system 10 includes an electrical connector 12 and a mating connector 14. The communication system 10 includes an electrical component 16 that includes the mating connector 14, and a receptacle assembly 18 that includes the electrical connector 12. The receptacle assembly 18 is configured to communicatively engage the electrical component 16. Specifically, the electrical connector 12 and the mating connector 14 are configured to mate together along a mating axis 20 to electrically connect the electrical component 16 to the receptacle assembly 18.

As shown in FIG. 1, the receptacle assembly 18 may include a circuit board 22 that includes a board surface 24 having a plurality of electrical contacts (not shown). The electrical contacts of the circuit board 22 may be, for example, contact pads, plated through-holes, and/or the like. The electrical connector 12 is configured to be mounted to the board surface 24 of the circuit board 22, as is shown in FIG. 1.

The mating connector 14 includes opposite rows 26 and 28 of electrical contacts 30 arranged on opposite sides 32 and 34 of a mating edge 36 of the mating connector 14. Only the row 26 of the electrical contacts 30 is visible in FIG. 1. The electrical connector 12 includes a receptacle 38 that is configured to receive the mating connector 14. Specifically, the receptacle 38 is configured to receive the mating edge 36 of the mating connector 14. The electrical connector 12 includes electrical contacts 40 that are arranged in opposing rows 42 and 44. The receptacle 38 is defined between the opposing rows 42 and 44 of the electrical contacts 40. As the connectors 12 and 14 are mated together, the mating edge 36 of the mating connector 14 is moved relative to the electrical connector 12 along the mating axis 20 into the receptacle 38 of the electrical connector 12. The rows 26 and 28 of the electrical contacts 30 of the mating connector 14 engage in electrical connection with corresponding electrical contacts 40 within the rows 42 and 44, respectively, of the electrical connector 12 to establish an electrical connection between the connectors 12 and 14 and thereby communicatively couple the circuit board 22 to the electrical component 16.

The electrical component 16 may be any type of electrical component, such as, but not limited to, a solid state drive, a memory module, a processor module, and/or the like. In some alternative embodiments, the mating connector 14 is a circuit board (not shown), which may define the electrical component 16 or the electrical component 16 may be mounted to the circuit board of the mating connector 14.

Although shown as being mounted on the board surface 24 of the circuit board 22, the electrical connector 12 may alternatively be a straddle-mount connector that straddles an edge 46 of the circuit board 22. Moreover, the electrical connector 12 includes a housing 48 that extends from a mating face 50 to an opposite face 52. In the illustrated embodiment, the face 52 of the housing 48 is mounted to the board surface 24 of the circuit board 22 such that the receptacle 38 of the electrical connector 12 opens away from the board surface 24, which may be commonly referred to as a "vertical connector". But, in some alternative embodiments, the electrical connector 12 is mounted to the board surface 24 of the circuit board 22 along a side wall 54 of the housing 48 such that the receptacle 38 opens in a direction that is approximately parallel to the plane of the board surface 24, which is commonly referred to as a "right-angle connector". The electrical connector 12 may be alternatively mounted to the circuit board 22 with other geometries. In embodiments wherein the electrical connector 12 is mounted to the circuit board 22 along the opposite face 52 (e.g., the illustrated embodiment), the opposite face 52 may be referred to herein as a "mounting face".

In some embodiments, the electrical connector 12 is configured to transmit high-speed data signals, such as, but not limited to, data signals greater than about 10 gigabits/second (Gbs), data signals greater than about 15 Gbs, or data signals greater than about 20 Gbs. In some embodiments, the electrical connector 12 is configured to transmit data signals at speeds up to approximately 24 Gbs or more.

Figure 2:
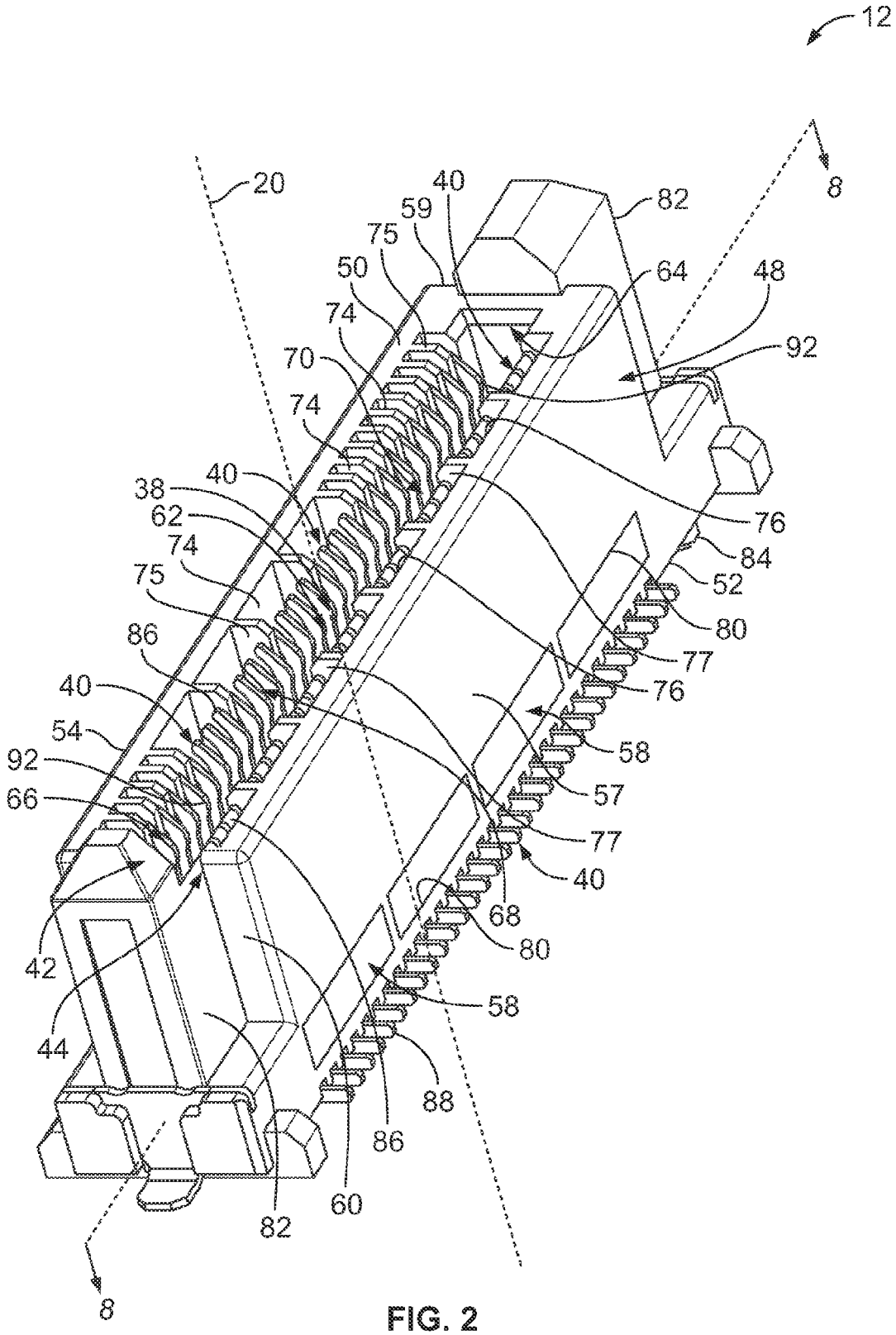
FIG. 2 is a perspective view of an embodiment of an electrical connector of the communication system shown in FIG. 1.
Figure 3:
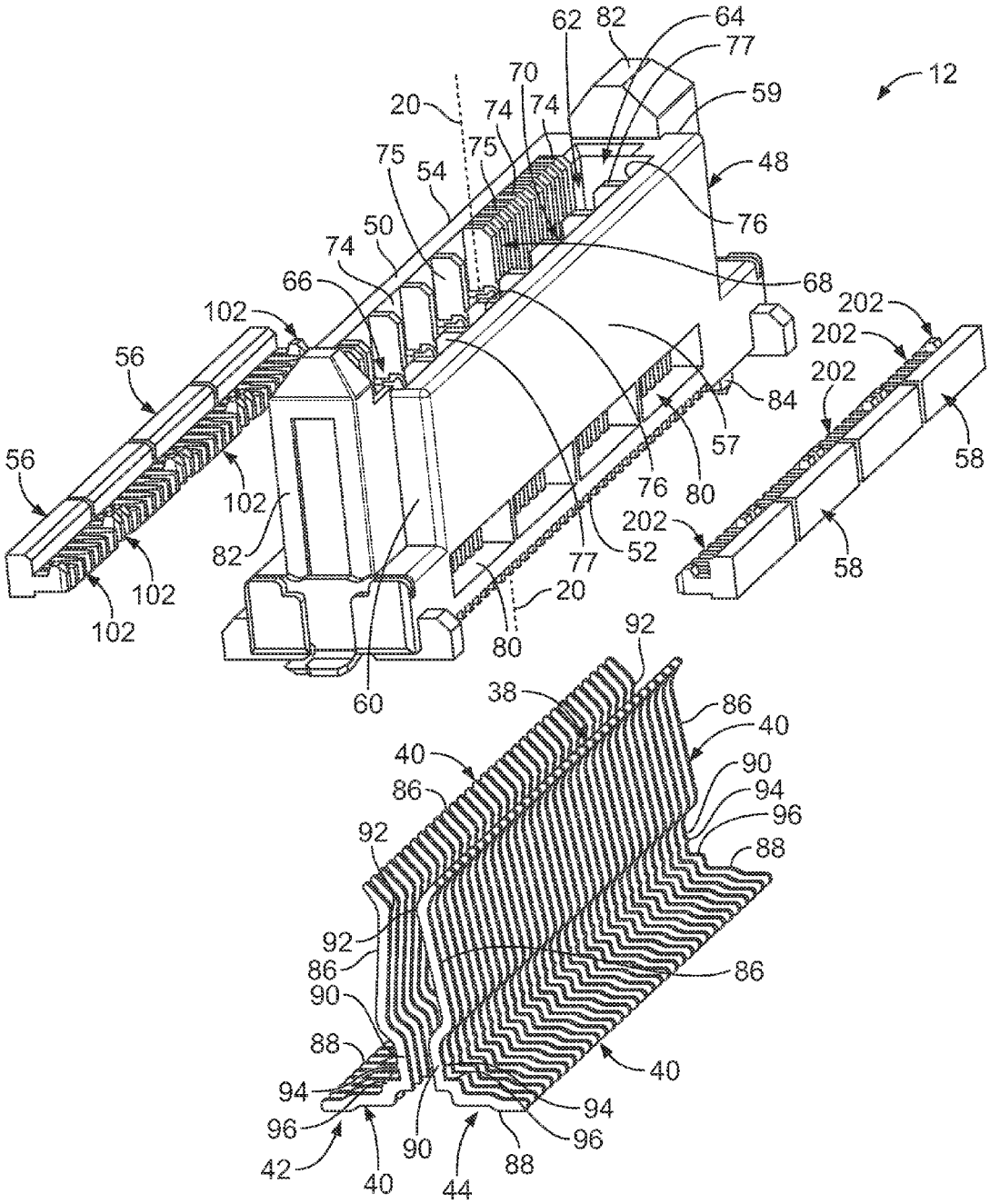
FIG. 3 is an exploded perspective view of the electrical connector shown in FIG. 2.

FIG. 2 is perspective view of an embodiment of the electrical connector 12. FIG. 3 is an exploded perspective view of the electrical connector 12. Referring now to FIGS. 2 and 3, the electrical connector 12 includes the housing 48, one or more retention inserts 56 and/or 58, and the electrical contacts 40. The retention inserts 56 are not visible in FIG. 2. The housing 48 extends along the mating axis 20 from the mating face 50 to the opposite face 52. The housing 48 includes the sidewall 54, a side wall 57 that is opposite the side wall 54, and opposite end walls 59 and 60. The side walls 54 and 57 and the end walls 59 and 60 extend between the mating face 50 and the opposite face 52 such that the walls 54, 57, 59, and 60 connect the faces 50 and 52. In the illustrated embodiment, the housing 48 generally has the shape of a parallelepiped. But, the housing 48 may have other geometries in some alternative embodiments. Each of the side walls 54 and 57 may be referred to herein as a "first" and/or a "second" side wall. Each of the retention inserts 56 and 58 may be referred to herein as a "first" and/or a "second" retention insert.

The housing 48 includes a contact cavity 62 that extends through the housing 48 along the mating axis 20. Specifically, the contact cavity 62 extends through the mating face 50, through the opposite face 52, and through the body of the housing 48 between the faces 50 and 52. The contact cavity 62 extends a length from an end 64 to an opposite end 66. The ends 64 and 66 are defined by interior surfaces of the housing 48 that extend from the mating face 50 to the opposite face 52. The contact cavity 62 includes opposing sides 68 and 70 that are defined by interior surfaces of the housing 48 that extend from the mating face 50 to the opposite face 52. The housing 48 includes a center divider 72 (FIGS. 5-8) that extends within the contact cavity 62 along at least a portion of the length of the contact cavity 62.

The housing 48 includes contact channels 74 and 76 that extend along the sides 68 and 70, respectively, of the contact cavity 62. The contact channels 74 and 76 extend along at least a portion of the respective sides 68 and 70 between the mating face 50 and the opposite face 52. The contact channels 74 and 76 are partially defined by divider walls 75 and 77, respectively, that extend along at least a portion of the respective sides 68 and 70 between the mating face 50 and the opposite face 52. As shown in FIG. 2, the electrical contacts 40 within the row 42 extend within the contact channels 74 of the housing 48 and the electrical contacts 40 within the row 44 extend within the contact channels 76.

The housing 48 includes one or more side openings 78 that extend through the side wall 54 and/or includes one or more side openings 80 that extend through the side wall 56. The side openings 78 are not visible in FIGS. 2 and 3, but can be seen in FIGS. 5-8. The side openings 78 and 80 extend through the respective side walls 54 and 56 into communication with the contact cavity 62. As will be described below, the side openings 78 and 80 are configured to receive the retention inserts 56 and 58, respectively, to hold the electrical contacts 40 within the contact cavity 62. Each of the side openings 78 and 80 may be referred to herein as a "first" and/or a "second" side opening.

In the illustrated embodiment, the housing 48 includes a plurality of the side openings 78 and a plurality of the side openings 80. But, the housing 48 may include any number of the side openings 78 for receiving any number of retention inserts 56. Moreover, the housing 48 may include any number of the side openings 80 for receiving any number of the retention inserts 58.

The housing 48 may include one or more alignment features that facilitate aligning the housing 48 with the mating connector 14 (FIG. 1), such as, but not limited to, one or more cavities, recesses, edges, posts, and/or the like. Such alignment features may be configured to engage corresponding alignment features of the mating connector 14. For example, in the illustrated embodiment, the housing 48 includes alignment posts 82 that extend outward along the mating face 50 for being received within corresponding openings (not shown) of the mating connector 14 (FIG. 1). Although two are shown, the housing 48 may include any number of the alignment posts 82.

The opposite face 52 of the housing 48 may include one or more alignment features that facilitate aligning the housing 48 with the circuit board 22 (FIG. 1), such as, but not limited to, one or more cavities, recesses, edges, posts, and/or the like. Such alignment features may be configured to engage corresponding alignment features of the circuit board 22. In the illustrated embodiment, and for example, the housing 48 includes alignment posts 84 that extend outward along the opposite face 52 of the housing 48 for being received within corresponding openings (not shown) of the circuit board 22. The housing 48 includes two alignment posts 84 in the illustrated embodiment, but the housing 48 may include any number of the alignment posts 84.

Referring now solely to FIG. 3, the electrical contacts 40 include mating segments 86, mounting segments 88, and retention segments 90. The electrical contacts 40 are configured to mate with the corresponding electrical contacts 30 (FIG. 1) of the mating connector 14 (FIG. 1) at the mating segments 86. Specifically, the mating segments 86 include mating interfaces 92 that are configured to engage in electrical connection with mating segments (not shown) of the corresponding electrical contacts 30 of the mating connector 14 to electrically interconnect the connectors 12 and 14.

The mounting segments 88 of the electrical contacts 40 are configured to be mounted to the circuit board 22 (FIG. 1). In the illustrated embodiment, the mounting segments 88 are surface mount members that are configured to be mounted in electrical connection to contact pads (not shown) that extend on the board surface 24 (FIG. 1) of the circuit board 22. But, alternatively the mounting segments 88 may have other geometries, such as, but not limited to, solder tails, press-fit pins (e.g., eye-of-the needle pins and/or the like), and/or the like.

The retention segments 90 of the electrical contacts 40 extend between the mating segments 86 and the mounting segments 88. Specifically, the retention segment 90 of each electrical contact 40 extends from the mating segment 86 to the mounting segment 88 such that the retention segment 90 interconnects the segments 86 and 88. Optionally, the retention segments 90 include barbs 94 that extend outward along outer edges of the electrical contacts 40. The retention segments 90 optionally include ledges 96. As will be described below, the barbs 94 and the ledges 96 are configured to engage the corresponding retention insert 56 or 58 to facilitate holding the electrical contacts 40 within the contact cavity 62.

Referring now solely to FIG. 2, the electrical contacts 40 are held by the housing 48 within the contact cavity 62. The electrical contacts 40 are arranged in the rows 42 and 44. Specifically, the row 42 of the electrical contacts 40 extends along the side 68 of the contact cavity 62, while the row 44 of the electrical contacts 40 extends along the side 70 of the contact cavity 62. As can be seen in FIG. 2, portions of the mating segments 86 of the electrical contacts 40 within the row 42 extend within the corresponding contact channels 74 of the side 68 of the contact cavity 62, while portions of the mating segments 86 of the electrical contacts 40 within the row 44 extend within the corresponding contact channels 76 of the side 70 of the contact cavity 62. As can also be seen in FIG. 2 (at least with respect to the row 42), the portions of the mating segments 86 that include the mating interfaces 92 extend outward from the corresponding contact channels 74 or 76 to expose the mating interfaces 92 for engagement with the corresponding electrical contacts 30 (FIG. 1) of the mating connector 14 (FIG. 1). Although not visible in FIG. 2, the retention segments 90 of the electrical contacts 40 within the row 42 extend within the corresponding contact channels 74, while the retention segments 90 of the electrical contacts 40 within the row 44 extend within the corresponding contact channels 76. Extension of the retention segments 90 within the contact channels 74 and 76 is better illustrated in FIGS. 7 and 8.

The contact cavity 62 of the housing 48 is accessible through the mating face 50 for receiving the mating edge 36 (FIG. 1) of the mating connector 14. Specifically, the mating interfaces 92 of the electrical contacts 40 within the row 42 oppose the mating interfaces 92 of the electrical contacts 40 within the row 44. The receptacle 38 of the electrical connector 12 that receives the mating edge 36 of the mating connector 14 is the portion of the contact cavity 62 that is defined between the opposing rows 42 and 44 of the electrical contacts 40. Specifically, the receptacle 38 is the portion of the contact cavity 62 that is defined between the mating interfaces 92 of the electrical contacts 40 within the row 42 and the mating interfaces 92 of the electrical contacts 40 within the row 44. Each of the rows 42 and 44 may be referred to herein as a "first" and/or a "second" row.

As can be seen in FIG. 2, the mounting interfaces 88 of the electrical contacts 40 are exposed along the opposite face 52 of the housing 48 for mounting the electrical contacts 40 to the board surface 24 (FIG. 1) of the circuit board 22 (FIG. 1).

In the illustrated embodiment, the contact cavity 62 of the housing 48 is accessible through the opposite face 52 of the housing 48 for loading the electrical contacts 40 into the contact cavity 62. Specifically, the electrical contacts 40 are configured to be inserted into the contact cavity 62 through the opposite face 52 of the housing 48. But, in addition or alternatively to being configured to be inserted into the contact cavity 62 through the opposite face 52, the electrical contacts 40 may be configured to be inserted into the contact cavity 62 through the mating face 50. In embodiments wherein the electrical contacts 40 are configured to be inserted into the contact cavity 62 through the opposite face 52, the opposite face 52 may be referred to herein as a "loading face".

Figure 4:
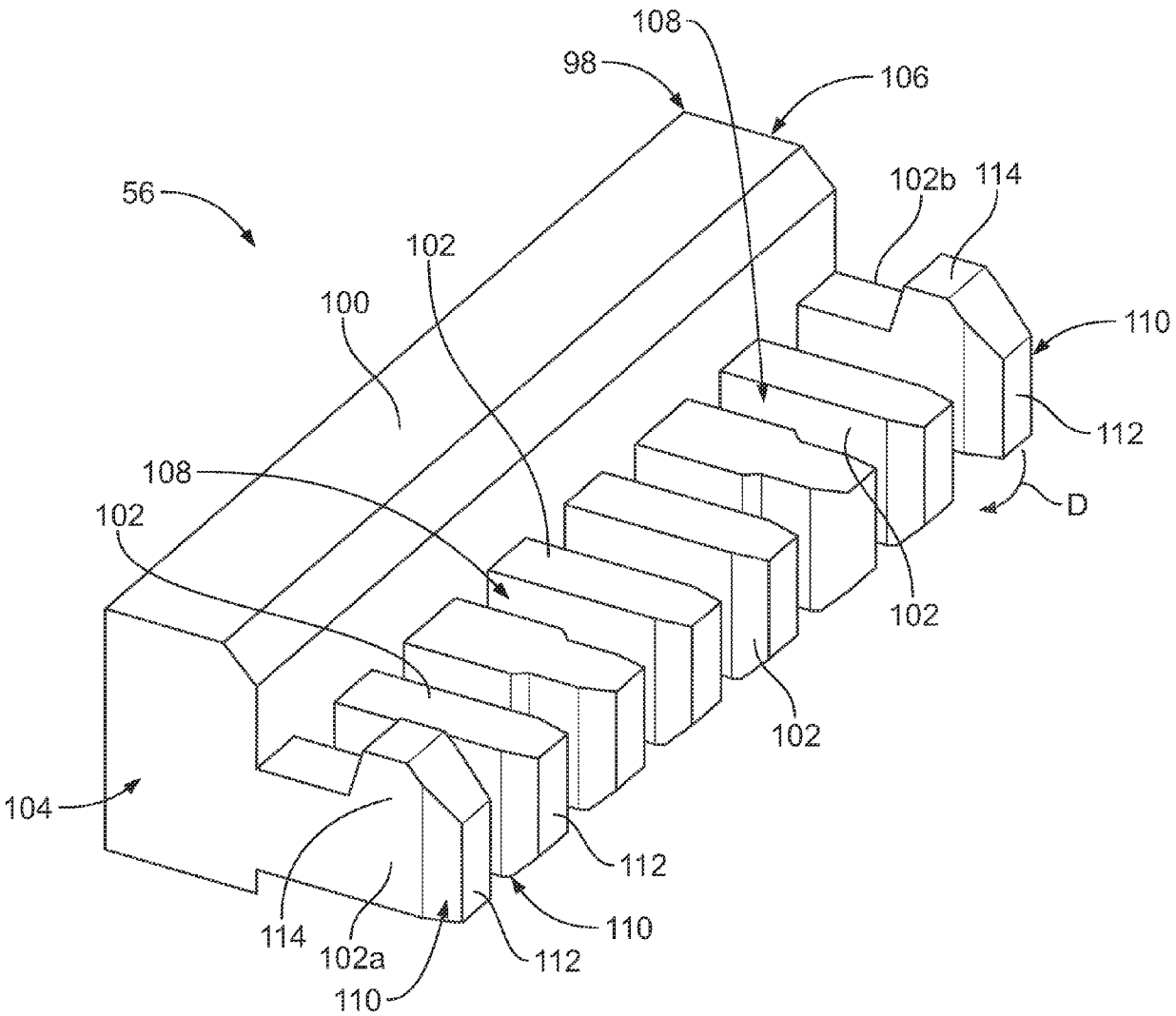
FIG. 4 is a perspective view of an embodiment of a retention insert of the electrical connector shown in FIGS. 2 and 3.

FIG. 4 is a perspective view of an embodiment of one of the retention inserts 56. Each retention insert 58 is substantially similar to the retention insert 56 shown in FIG. 4. Accordingly, the geometry of the retention inserts 58 will not be separately described herein. But, the function of the retention inserts 58 will be described below with reference to FIGS. 7 and 8 along with the function of the retention inserts 56.

The retention insert 56 includes a dielectric body 98 that includes a base 100 and fingers 102 that extend outward from the base 100. The base 100 extends a length from an end 104 to an opposite end 106. The fingers 102 are spaced apart from each other along the length of the base 100 by divider channels 108 that extend between adjacent fingers 102. The divider channels 108 are configured to receive corresponding divider walls 75 (FIGS. 2 and 3) of the housing 48 (FIGS. 1-3 and 5-8) therein when the retention insert 56 is received within the corresponding side opening 78 (FIGS. 5-8) of the housing 48.

The fingers 102 of the retention insert 56 extend outward from the base 100 to ends 110 of the fingers 102 that include pressing surfaces 112. As will be described below, the pressing surfaces 112 of the fingers 102 are configured to engage in physical contact with corresponding electrical contacts 40 (FIGS. 1-3 and 5-8) to hold the corresponding electrical contacts 40 within the contact cavity 62 (FIGS. 2, 3, and 5-8) of the housing 48. Although shown as having the general shape of a parallelepiped, each finger 102 may have any other shape. Moreover, although eight are shown, the retention insert 56 may include any number of the fingers 102 for engaging any number of the electrical contacts 40.

As shown in FIG. 4, at least one of the fingers 102 of the retention insert 56 includes a connection member 114 that cooperates with a connection member 116 (FIGS. 5 and 7) of the housing 48 to hold the retention insert 56 within the corresponding side opening 78 of the housing 48. In the illustrated embodiment, the connection member 114 is a snap-fit connection member that cooperates with the connection member 116 of the housing 48 with a snap-fit connection. Specifically, the connection member 114 includes a protrusion that extends outwardly on the corresponding finger 102. The end 110 of the corresponding finger 102 is configured to resiliently deflect along an arc D and thereafter snap back to the undeflected position shown in FIG. 4. In addition or alternatively to the snap-fit connection member, the connection member 114 may include any other structure, connection type, and/or the like for cooperating with the housing 48 to hold the retention insert 56 within the corresponding side opening 78. Examples of other types of structures, connection types, and/or the like of the connection member 114 include, but are not limited to, an interference fit, a clamp, a band, a threaded fastener, and/or the like.

In the illustrated embodiment, fingers 102a and 102b that extend at the ends 104 and 106, respectively, of the base 100 include connection members 114. But, any other fingers 102 of the retention insert 56 may include the connection member 114 in addition or alternatively to the fingers 102a and/or 102b. Moreover, although two are shown in the illustrated embodiment, any number of the fingers 102 may include the connection member 114.

Referring again to FIG. 3, in the illustrated embodiment, the electrical connector 12 includes a plurality of the retention inserts 56 and a plurality of the retention inserts 58. But, the electrical connector 12 may include any number of the retention inserts 56 and any number of the retention inserts 58. In some embodiments, the electrical connector 12 includes a single retention insert 56 that extends along at least an approximate majority of the length of the contact cavity 62. Moreover, in some embodiments, the electrical connector 12 includes a single retention insert 58 that extends along at least an approximate majority of the length of the contact cavity 62. The fingers 102 of each retention insert 56 may be referred to herein as a "first" and/or a "second" plurality of fingers. Similarly, fingers 202 of each retention insert 58 may be referred to herein as a "first" and/or a "second" plurality of fingers.

Figure 5:
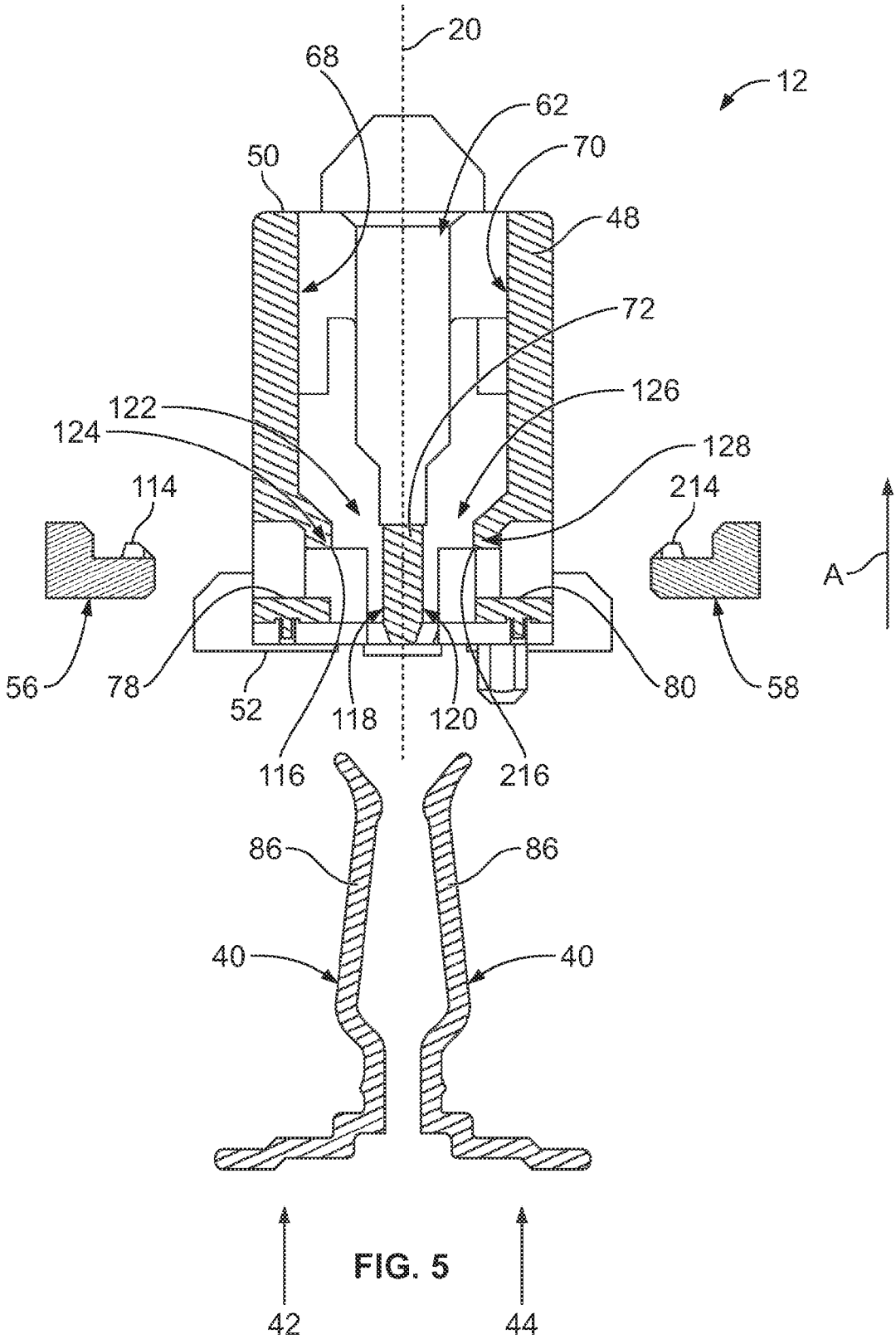
FIG. 5 is an exploded cross-sectional view of the electrical connector shown in FIGS. 2 and 3 illustrating an embodiment of loading of electrical contacts of the electrical connector within a housing of the electrical connector.

FIG. 5 is an exploded cross-sectional view of the electrical connector 12 illustrating an embodiment of loading of the electrical contacts 40 into the housing 48. As described above, in the illustrated embodiment, the contact cavity 62 of the housing 48 is accessible through the opposite face 52 of the housing 48 for loading the electrical contacts 40 into the contact cavity 62. Specifically, the electrical contacts 40 are configured to be inserted into the contact cavity 62 through the opposite face 52 of the housing 48 by advancing the electrical contacts 40 along the mating axis 20 in the direction of the arrow A from a position below (as viewed in FIG. 5) the opposite face, as is shown in FIG. 5.

As shown in FIG. 5, the housing 48 of the electrical connector 12 includes the center divider 72, which as described above extends within the contact cavity 62 along at least a portion of the length of the contact cavity 62. The center divider 72 includes opposite sides 118 and 120.

The contact cavity 62 of the housing 48 includes retention openings 122 that are defined between the side 118 of the center divider 72 and a structure 124 of the housing 48 that extends along the side 68 of the contact cavity 62. Similarly, retention openings 126 are defined between the side 120 of the center divider 72 and a structure 128 of the housing 48 that extends along the side 70 of the contact cavity 62. Each retention opening 122 has a size that is large enough to enable the mating segment 86 of the corresponding electrical contact 40 within the row 42 to pass through the retention opening 122 as the corresponding electrical contact 40 is loaded into the contact cavity 62. Similarly, each retention opening 126 has a size that is large enough to enable the mating segment 86 of the corresponding electrical contact 40 within the row 44 to pass through the retention opening 126 as the corresponding electrical contact 40 is loaded into the contact cavity 62.

The retention inserts 56 and 58 are shown in FIG. 5 as exploded from the housing 48 for insertion into the respective side openings 78 and 80 of the housing 48 to retain the electrical contacts 40 therein, as will be described below. As can be seen in FIG. 5, the structure 124 of the housing 48 includes the connection member 116 that cooperates with the connection member 114 of the retention insert 56 to hold the retention insert 56 within the corresponding side opening 78 of the housing 48. In the illustrated embodiment, the connection member 116 is a shoulder that cooperates with the connection member 114 of the retention insert 56 with a snap-fit connection, as will be described below. The structure 128 of the housing 48 also includes a connection member 216 that cooperates with a connection member 214 of the retention insert 58 to hold the retention insert 58 within the corresponding side opening 80 of the housing 48. In the illustrated embodiment, the connection member 216 is a shoulder that cooperates with the connection member 214 of the retention insert 58 with a snap-fit connection, as will be described below.

Figure 6:
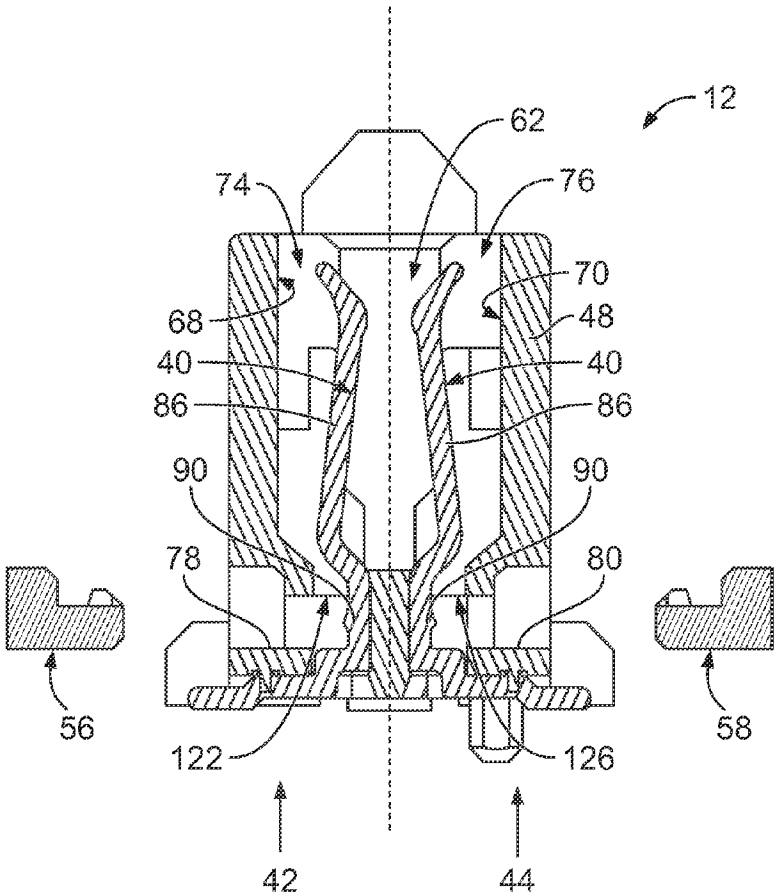
FIG. 6 is a cross-sectional view of the electrical connector shown in FIGS. 2, 3, and 5 illustrating the electrical contacts of the electrical connector as loaded into the housing of the electrical connector.

FIG. 6 is a cross-sectional view of the electrical connector 12 illustrating the electrical contacts 40 as loaded into the contact cavity 62 of the housing 48. As can be seen in FIG. 6, the electrical contacts 40 are arranged in the rows 42 and 44. Portions of the mating segments 86 of the electrical contacts 40 within the row 42 extend within the corresponding contact channels 74 of the side 68 of the contact cavity 62, while portions of the mating segments 86 of the electrical contacts 40 within the row 44 extend within the corresponding contact channels 76 of the side 70 of the contact cavity 62. As can also be seen in FIG. 6, the retention segments 90 of the electrical contacts 40 within the row 42 extend within the corresponding contact channels 74, while the retention segments 90 of the electrical contacts 40 within the row 44 extend within the corresponding contact channels 76.

As should be apparent from a comparison of FIGS. 5 and 6, the mating segments 86 of the electrical contacts 40 within the row 42 have been passed through the corresponding retention openings 122. Similarly, the mating segments 86 of the electrical contacts 40 within the row 44 have been passed through the corresponding retention openings 126.

Once the electrical contacts 40 have been loaded into the contact cavity 62 of the housing 48 as shown in FIG. 6, the retention inserts 56 and 58 can be inserted into the respective side openings 78 and 80 of the housing 48 to retain the electrical contacts 40 therein.

Figure 7:
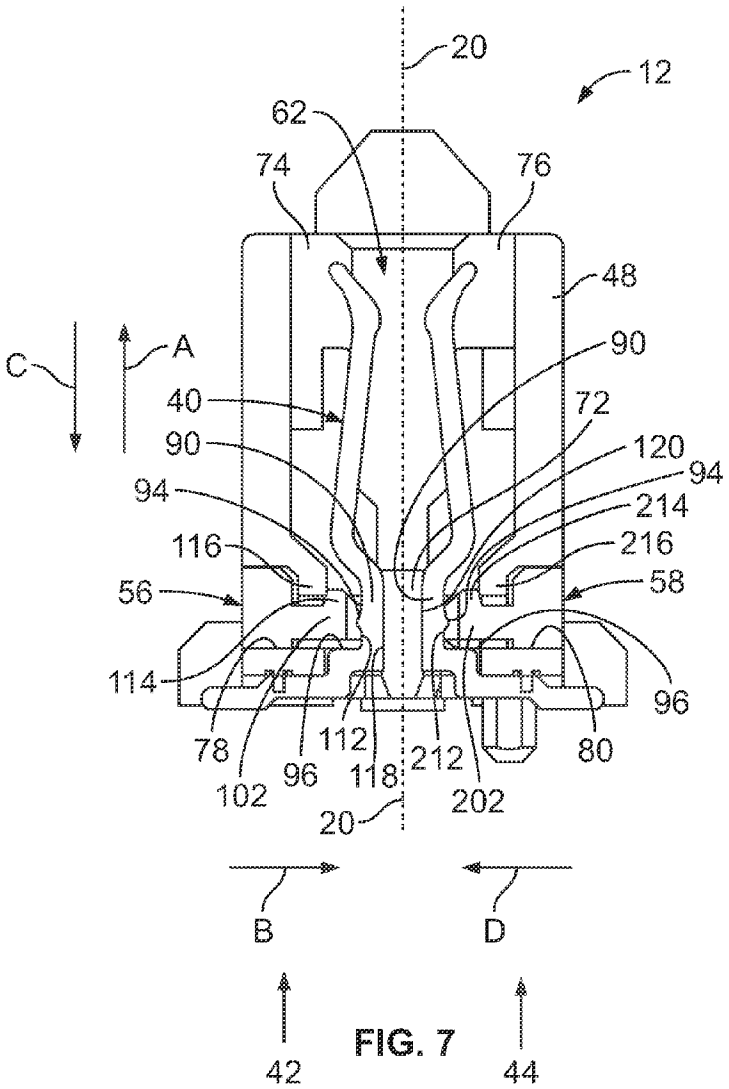
FIG. 7 is a cross-sectional view of the electrical connector shown in FIGS. 2, 3, 5, and 6 illustrating an embodiment of retention inserts of the electrical connector loaded into the housing of the electrical connector.
Figure 8:
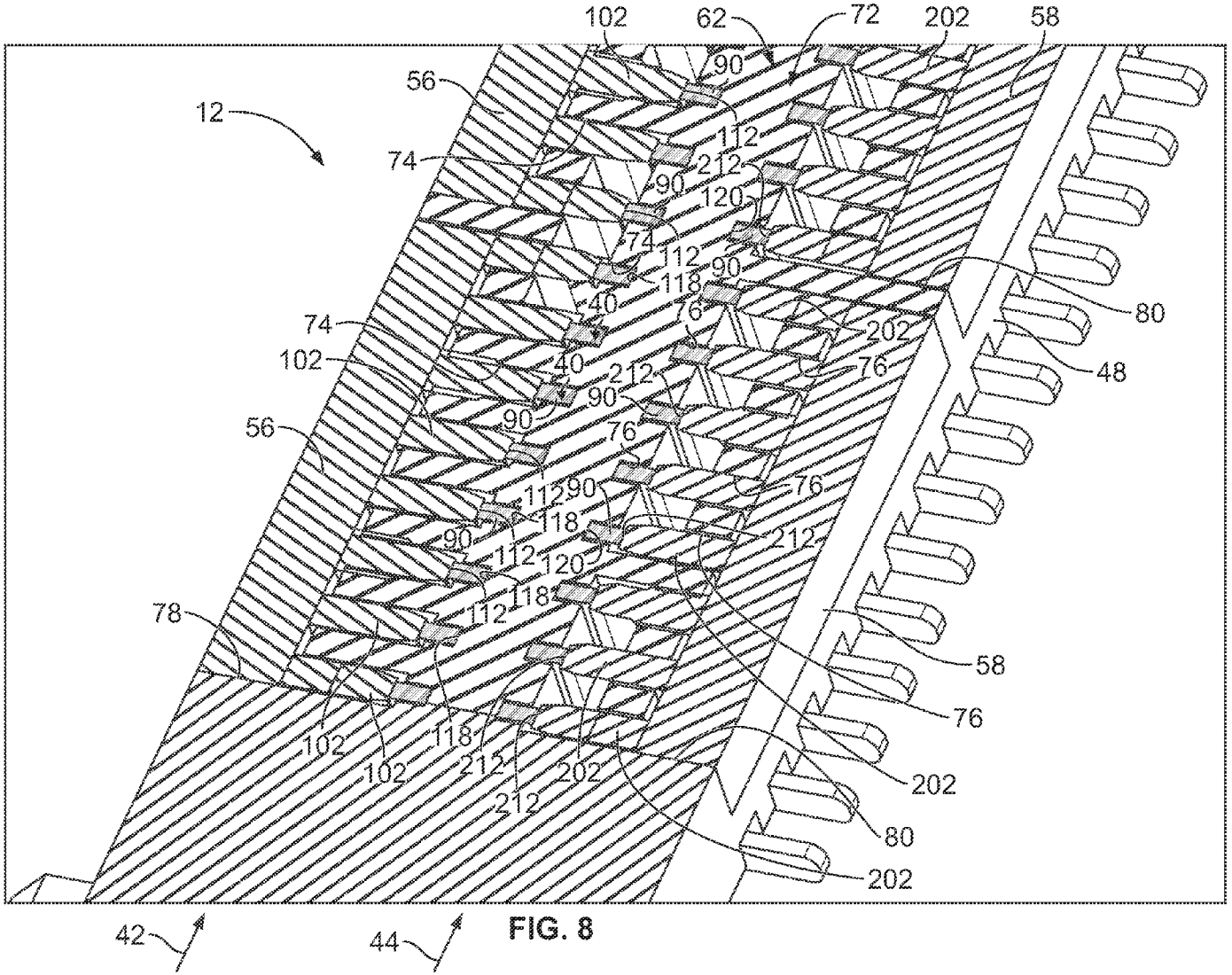
FIG. 8 is another cross-sectional view of the electrical connector shown in FIGS. 2, 3, and 5-7 taken along line 8-8 of FIG. 2.

FIG. 7 is a cross-sectional view of the electrical connector 12 illustrating the retention inserts 56 and 58 as loaded into the housing 48. FIG. 8 is another cross-sectional view of the electrical connector 12 taken along line 8-8 of FIG. 2. Referring now to FIGS. 7 and 8, the retention inserts 56 are received into the corresponding side openings 78 of the housing 48. As can be seen in FIG. 7, the retention inserts 56 extend into the side openings 78 in a direction B that is approximately perpendicular to the mating axis 20. The fingers 102 of the retention inserts 56 extend through the corresponding side opening 78 and into the contact cavity 62. The fingers 102 engage in physical contact with the corresponding electrical contacts 40 of the row 42. Specifically, the fingers 102 of the retention inserts 56 extend within the corresponding contact channels 74 into engagement with the corresponding electrical contacts 40. The pressing surfaces 112 of the fingers 102 engage in physical contact with the retention segments 90 of the corresponding electrical contacts 40 such that the fingers 102 press the corresponding retention segments 90 against the side 118 of the center divider 72. In other words, the retention segments 90 of the electrical contacts 40 within the row 42 are engaged between the center divider 72 and the pressing surfaces 112 of the corresponding fingers 102. As can be seen in FIG. 8, the contact channels 74 extend into the center divider 72 such that the side 118 of the center divider defines portions of the contact channels 74.

The pressing of the retention segments 90 against the center divider 72 by the fingers 102 of the retention inserts 56 holds (i.e., retains) the electrical contacts 40 of the row 42 within the contact cavity 62 of the housing 48. Referring now solely to FIG. 7, the barbs 94 of the retention segments 90 engage in physical contact with the pressing surfaces 112 of the fingers 102. Engagement between the barbs 94 and the pressing surfaces 112 may prevent the electrical contacts 40 from backing out of the contact cavity 62 in the direction of the arrow C. Engagement between the fingers 102 of the retention inserts 56 and the ledges 96 of the retention segments 90 of the electrical contacts 40 may prevent the electrical contacts 40 from coming out of the contact cavity 62 in the direction of the arrow A.

The retention inserts 56 are held within the corresponding side openings 78 in engagement with the electrical contacts 40 via cooperation of the connection members 114 of the retention inserts 56 with the connection members 116 of the housing 48. In the illustrated embodiment, the protrusion of the connection member 114 snaps over the shoulder of the connection member 116 as the retention inserts 56 are loaded into the side openings 78. The protrusion of the connection member 114 thereby hooks over the shoulder of the connection member 116 to hold the retention insert 56 within the corresponding side opening 78 in engagement with the corresponding electrical contacts 40, as is shown in FIG. 7. In addition to the snap-fit connection between the connection members 114 and 116, in the illustrated embodiment the retention inserts 56 cooperate with the corresponding side openings 78 with an interference fit to hold the retention inserts 56 within the corresponding side openings 78 in engagement with the corresponding electrical contacts 40.

Referring again to FIGS. 7 and 8, the retention inserts 58 are received into the corresponding side openings 80 of the housing 48. As can be seen in FIG. 7, the retention inserts 58 extend into the side openings 80 in a direction D that is approximately perpendicular to the mating axis 20. The fingers 202 of the retention inserts 58 extend through the corresponding side opening 80 and into the contact cavity 62. The fingers 202 engage in physical contact with the corresponding electrical contacts 40 of the row 44. Specifically, the fingers 202 of the retention inserts 58 extend within the corresponding contact channels 76 into engagement with the corresponding electrical contacts 40. Pressing surfaces 212 of the fingers 202 engage in physical contact with the retention segments 90 of the corresponding electrical contacts 40 such that the fingers 202 press the corresponding retention segments 90 against the side 120 of the center divider 72. In other words, the retention segments 90 of the electrical contacts 40 within the row 44 are engaged between the center divider 72 and the pressing surfaces 212 of the corresponding fingers 202. As can be seen in FIG. 8, the contact channels 76 extend into the center divider 72 such that the side 120 of the center divider defines portions of the contact channels 76.

The pressing of the retention segments 90 against the center divider 72 by the fingers 202 of the retention inserts 58 holds (i.e., retains) the electrical contacts 40 of the row 44 within the contact cavity 62 of the housing 48. Referring now solely to FIG. 7, the barbs 94 of the retention segments 90 engage in physical contact with the pressing surfaces 212 of the fingers 202. Engagement between the barbs 94 and the pressing surfaces 212 may prevent the electrical contacts 40 from backing out of the contact cavity 62 in the direction of the arrow C. Engagement between the fingers 202 of the retention inserts 58 and the ledges 96 of the retention segments 90 of the electrical contacts 40 may prevent the electrical contacts 40 from coming out of the contact cavity 62 in the direction of the arrow A.

The retention inserts 58 are held within the corresponding side openings 80 in engagement with the electrical contacts 40 via cooperation of connection members 214 of the retention inserts 58 with the connection members 216 of the housing 48. In the illustrated embodiment, the protrusion of the connection member 214 snaps over the shoulder of the connection member 216 as the retention inserts 58 are loaded into the side openings 80. The protrusion of the connection member 214 thereby hooks over the shoulder of the connection member 216 to hold the retention insert 58 within the corresponding side opening 80 in engagement with the corresponding electrical contacts 40, as is shown in FIG. 7. In addition to the snap-fit connection between the connection members 214 and 216, in the illustrated embodiment the retention inserts 58 cooperate with the corresponding side openings 80 with an interference fit to hold the retention inserts 58 within the corresponding side openings 80 in engagement with the corresponding electrical contacts 40.

The embodiments described and/or illustrated herein may provide an electrical connector that is capable of being manufactured without damaging electrical contacts of the electrical connector, without negatively affecting the electrical characteristics of the electrical contacts, and/or in a less costly manner than at least some known electrical connectors. The embodiments described and/or illustrated herein may provide an electrical connector having electrical contacts that include retention segments that do not negatively affect the electrical characteristics of the electrical contacts. For example, the embodiments described and/or illustrated herein may provide an electrical connector having electrical contacts that include retention segments that do not degrade the signal integrity of the electrical contacts and/or that do not cause electrical discontinuities, such as, but not limited to, reflections, impedance differences, electrical stubs, etc. The embodiments described and/or illustrated herein may provide an electrical connector having electrical contacts that include retention segments that are smaller than the retention segments of at least some known electrical contacts.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing extending from a mating face to an opposite face, the housing comprising first and second side walls that extend between the mating face and the opposite face, the housing having a contact cavity that includes opposing sides, the first side wall comprising a side opening that extends through the first side wall into communication with the contact cavity, the contact cavity being accessible through the mating face for receiving a mating connector therein;

electrical contacts held by the housing, the electrical contacts being arranged in opposing rows that extend along the opposing sides of the contact cavity; and a retention insert received within the side opening of the first side wall of the housing, the retention insert comprising fingers that extend into the contact cavity and engage in physical contact with corresponding electrical contacts of one of the rows of the electrical contacts to hold the corresponding electrical contacts within the contact cavity.

2. The electrical connector of claim 1, wherein the housing comprises a center divider that extends within the contact cavity, the fingers of the retention insert being configured to press the corresponding electrical contacts against the center divider to hold the corresponding electrical contacts within the contact cavity.

3. The electrical connector of claim 1, wherein the retention insert is a first retention insert, the side opening is a first side opening, and the opposing rows of the electrical contacts are first and second rows, the second side wall of the housing comprising a second side opening that extends through the second side wall into communication with the contact cavity, the electrical connector further comprising a second retention insert received within the second side opening, the second retention insert comprising fingers that extend into the contact cavity and engage in physical contact with corresponding electrical contacts of the second row of the electrical contacts to hold the corresponding electrical contacts within the contact cavity.

4. The electrical connector of claim 1, wherein the connector housing comprises contact channels that extend along the opposing sides of the contact cavity, the electrical contacts extending within corresponding contact channels, the fingers of the retention inserts extending within corresponding contact channels into the engagement with the corresponding electrical contacts.

5. The electrical connector of claim 1, wherein the housing comprises a center divider that extends within the contact cavity, the fingers of the retention insert being configured to engage in physical contact with the corresponding electrical contacts such that the corresponding electrical contacts are engaged between the center divider and pressing surfaces of the fingers.

6. The electrical connector of claim 1, wherein the electrical contacts include mounting segments, mating segments, and retention segments that extend between the mounting segments and the mating segments, the fingers of the retention insert being engaged in physical contact with the retention segments of the corresponding electrical contacts to hold the corresponding electrical contacts within the contact cavity.

7. The electrical connector of claim 1, wherein the retention insert cooperates with the housing with a snap-fit connection to hold the retention insert within the side opening of the first side wall.

8. The electrical connector of claim 1, wherein at least one of the fingers of the retention insert comprises a snap-fit connection member that cooperates with a shoulder of the housing with a snap-fit connection to hold the retention insert within the side opening of the first side wall.

9. The electrical connector of claim 1, wherein the housing extends from the mating face to the opposite face along a mating axis, the retention insert extending into the side opening of the first side wall of the housing in a direction that is approximately perpendicular to the mating axis.

10. The electrical connector of claim 1, wherein the opposite face of the housing is a loading face, the contact cavity being accessible through the loading face for loading the electrical contacts into the contact cavity through the loading face.

11. The electrical connector of claim 1, wherein the opposite face of the housing is a mounting face along which the electrical connector is configured to be mounted to an electrical component.

12. A receptacle assembly comprising:

a circuit board having a board surface; and an electrical connector configured to be mounted to the board surface of the circuit board in electrical connection with the circuit board, the electrical connector comprising:

a housing extending from a mating face to an opposite face, the housing comprising first and second side walls that extend between the mating face and the opposite face, the housing having a contact cavity that includes opposing sides, the first side wall comprising a side opening that extends through the first side wall into communication with the contact cavity, the contact cavity being accessible through the mating face for receiving a mating connector therein;

electrical contacts held by the housing, the electrical contacts being arranged in opposing rows that extend along the opposing sides of the contact cavity; and a retention insert received within the side opening of the first side wall of the housing, the retention insert comprising fingers that extend into the contact cavity and engage in physical contact with corresponding electrical contacts of one of the rows of the electrical contacts to hold the corresponding electrical contacts within the contact cavity.

13. The receptacle assembly of claim 12, wherein the housing comprises a center divider that extends within the contact cavity, the fingers of the retention insert being configured to press the corresponding electrical contacts against the center divider to hold the corresponding electrical contacts within the contact cavity.

14. The receptacle assembly of claim 12, wherein the retention insert is a first retention insert, the side opening is a first side opening, and the opposing rows of the electrical contacts are first and second rows, the second side wall of the housing comprising a second side opening that extends through the second side wall into communication with the contact cavity, the electrical connector further comprising a second retention insert received within the second side opening, the second retention insert comprising fingers that extend into the contact cavity and engage in physical contact with corresponding electrical contacts of the second row of the electrical contacts to hold the corresponding electrical contacts within the contact cavity.

15. The receptacle assembly of claim 12, wherein the connector housing comprises contact channels that extend along the opposing sides of the contact cavity, the electrical contacts extending within corresponding contact channels, the fingers of the retention inserts extending within corresponding contact channels into the engagement with the corresponding electrical contacts.

16. The receptacle assembly of claim 12, wherein the housing comprises a center divider that extends within the contact cavity, the fingers of the retention insert being configured to engage in physical contact with the corresponding electrical contacts such that the corresponding electrical contacts are engaged between the center divider and pressing surfaces of the fingers.

17. The receptacle assembly of claim 12, wherein at least one of the fingers of the retention insert comprises a snap-fit connection member that cooperates with a shoulder of the housing with a snap-fit connection to hold the retention insert within the side opening of the first side wall.

18. The receptacle assembly of claim 12, wherein the opposite face of the housing is a loading face, the contact cavity being accessible through the loading face for loading the electrical contacts into the contact cavity through the loading face.

19. The receptacle assembly of claim 12, wherein the opposite face of the housing is a mounting face along which the electrical connector is configured to be mounted to an electrical component.

20. An electrical connector comprising:

a housing extending from a mating face to an opposite face, the housing comprising first and second side walls that extend between the mating face and the opposite face, the housing having a contact cavity that includes opposing sides, the first and second side walls comprising first and second side openings, respectively, that extend through the first and second side walls, respectively, into communication with the contact cavity, the contact cavity being accessible through the mating face for receiving a mating connector therein;

electrical contacts held by the housing, the electrical contacts being arranged in opposing first and second rows that extend along the opposing sides of the contact cavity; and first and second retention inserts received within the first and second side openings, respectively, of the housing, the first and second retention inserts comprising respective first and second pluralities of fingers that extend into the contact cavity and engage in physical contact with corresponding electrical contacts of the first and second rows, respectively, to hold the corresponding electrical contacts within the contact cavity.

* * * * *